US005526540A

United States Patent [19]

Johnson

[11] Patent Number: 5,526,540

[45] Date of Patent: Jun. 18, 1996

[54] HYDROTHERAPY NOZZLE ASSEMBLY

[75] Inventor: Dwight N. Johnson, Carlsbad, Calif.

[73] Assignee: American Standard Inc., Piscataway, N.J.

[21] Appl. No.: 412,339

[22] Filed: Mar. 31, 1995

[51] Int. Cl.[6] ..... A61H 33/02

[52] U.S. Cl. ..... 4/541.6; 4/541.1

[58] Field of Search ..... 4/541.1, 541.3, 4/541.4, 541.6, 492, 507

[56] References Cited

U.S. PATENT DOCUMENTS

| | | | |
|---|---|---|---|
| 3,297,025 | 1/1967 | Jacuzzi | 4/541.6 X |
| 3,391,870 | 7/1968 | Nash | 4/541.6 X |
| 4,408,721 | 10/1983 | Cohen et al. | 239/417 |
| 4,537,358 | 8/1985 | Anderson | 4/541.6 X |
| 4,541,780 | 9/1985 | Moreland | 4/541.6 |
| 4,593,420 | 6/1986 | Tobias et al. | 4/496 |
| 4,671,463 | 6/1987 | Moreland et al. | 4/541.6 X |
| 4,982,459 | 1/1991 | Henkin et al. | 4/541.6 X |
| 4,985,943 | 1/1991 | Tobias et al. | 4/541.6 |
| 5,269,029 | 12/1993 | Spears et al. | 4/541.6 |

*Primary Examiner*—Robert M. Fetsuga
*Attorney, Agent, or Firm*—Mason, Kolehmainen, Rathburn & Wyss

[57] ABSTRACT

A nozzle assembly includes a housing with a mounting flange, a cavity, and a skirt extending from the flange to the cavity. Water and air supply ports communicate with the cavity and a socket ring divides the cavity into water and air supply regions. A discharge ball assembly includes a ball pivotally received in the socket and a discharge nozzle. A bezel has a lip covering the mounting flange, a skirt covering the housing skirt and surrounding the discharge nozzle and an end portion retaining the ball in the socket. Water and air flows are controlled by a valve member within the ball, and an additional water path provides continuous flow to an ejector orifice leading to a mixing region where air is entrained in the water flow. The discharge nozzle rotates to control the valve member but does not move axially. A clamp member is drawn by fasteners against the tub surface opposite to the mounting flange, and the housing can be mounted in different positions. In each mounting position, drain paths in the socket, the housing skirt and the bezel lip are aligned at the lowermost part of the assembly to drain water from the assembly after use.

32 Claims, 7 Drawing Sheets

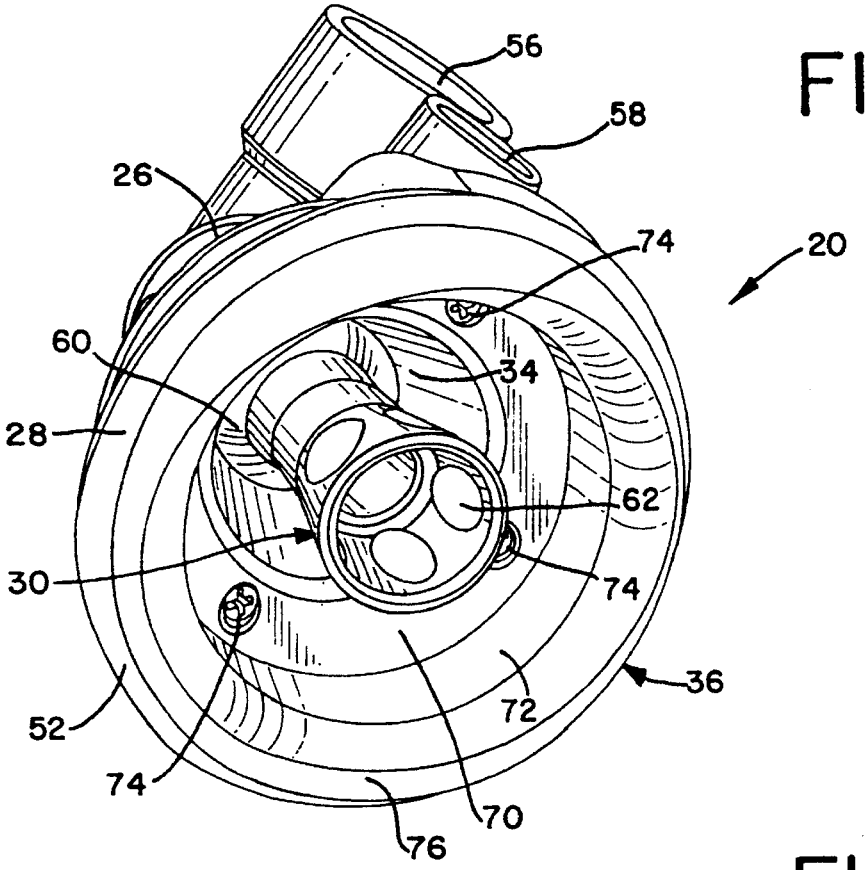
FIG. 1
FIG. 2
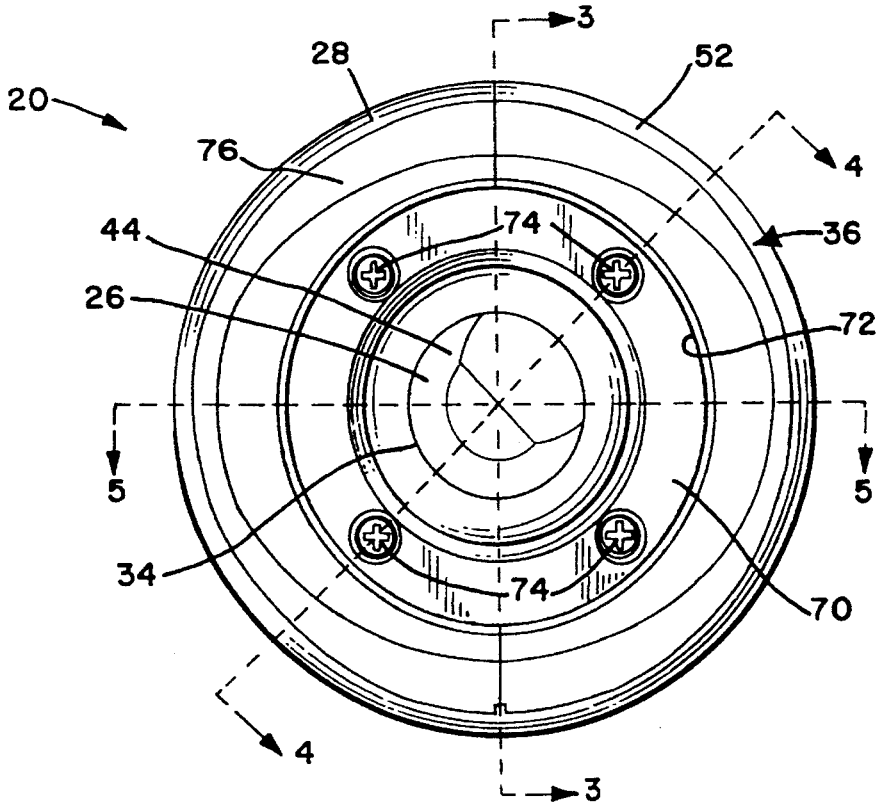

HYDROTHERAPY NOZZLE ASSEMBLY

FIELD OF THE INVENTION

The present invention relates to an improved hydrotherapy nozzle assembly for tubs and spas.

DESCRIPTION OF THE PRIOR ART

Whirlpool or hydrotherapeutic baths include a tub with nozzle assemblies for introducing a jet of water and air into water contained in the tub. Water and air are supplied through manifold pipes to the nozzle assembly where they are mixed and discharged as a jet into the tub. In one common approach, water flows through an orifice and is ejected into a mixing region where air is entrained in the high velocity water stream. In known arrangements, the volume of water or the volume of air or both can be adjusted by the user, and the direction of the jet introduced into the tub can be varied.

Some known hydrotherapy nozzle assemblies rely on shear type valving of the water supply in which the area of a radial water flow path leading to the ejector section is varied by a valve surface. A disadvantage is that the flow to the ejector section is turbulent and efficiency is reduced. U.S. Pat. Nos. 3,297,025, 4,541,780, 4,671,463 and 4,985,943 disclose assemblies in which rotation of a central nozzle portion provides a valving function in which the flow of water and air is reduced by a shear valve operation. U.S. Pat. No. 4,982,459 discloses at FIGS. 6–18 a nozzle assembly with adjustable shear valving of air and water flows, and with a central axial water flow path so that the flow of water cannot be entirely blocked by the valve.

Some known assemblies avoid shear type valving by throttling an annular flow of water. In known assemblies of this type the adjustment member moves axially, with a rising valve action. This can result in projection of the rising member into the tub in the full open position and in an undesireably short axial flow path through the assembly. In addition, the large surface area of the annular throttling surfaces in contact with the accelerating water results in boundary layer losses and reduced efficiency. U.S. Pat. No. 5,269,029 discloses a jet assembly with a push pull throttling valve operation. U.S. Pat. No. 3,391,870 discloses a therapeutic discharge fitting assembly wherein the flow of water through the assembly is varied by throttling of an annular flow path by axial, or rising movement of a central nozzle portion. U.S. Pat. No. 4,408,721 discloses rising throttling control of both air and water flow wherein the central nozzle is retracted to such an extent that the axial length of the ejector-aspirator system is undesireably short.

Whirlpool baths have become increasingly popular, and tub sizes have increased. The size and power of pumps used in whirlpool and spa systems have also increased. However, systems requiring large and powerful pumps have disadvantages including the need to prevent entrapment of scalp hair in the suction fitting of the tub, the expense of electrical power and the requirement for large pipes or manifolds to accommodate high volume water flows. Thus there is a need for nozzle assemblies of high efficiency that are capable of delivering effective jets of air and water without the need for large and powerful pumps.

Most known hydrotherapy nozzle assemblies are mounted to a tub wall by capturing the tub wall between two mating threaded parts. The parts can be loosened if they are unthreaded by rotational forces applied to the assembly, for example by rotation of a central nozzle to adjust flow. U.S. Pat. Nos. 4,593,420 and 4,982,459 illustrate this typical mounting arrangement. Although U.S. Pat. No. 4,537,358 discloses a mounting system where parts are drawn against inner and outer tub wall surfaces by separate fasteners, the mounting system of that patent is not consistent with a neat and compact nozzle assembly having an attractive appearance.

It is desirable to drain the water from a whirlpool nozzle assembly and related manifold piping following operation of the tub. U.S. Pat. No. 4,593,420 discloses a fitting including a locking ring having grooves that provide a drain path from an air and water mixing chamber around an outer nozzle. Because there is no way to assure that a single groove will be located properly for drainage, numerous drain grooves are provided. During operation, the grooves bypass flow through the nozzle assembly and because numerous grooves are needed, their size is critical.

SUMMARY OF THE INVENTION

A principal object of the present invention is to provide an improved nozzle assembly for hydrotherapy tubs such as spas and whirlpool baths. Other objects are to provide a nozzle assembly in which the hydraulic energy of the water supplied to the assembly is converted to a jet of water and air with high efficiency; to provide a nozzle assembly in which setting of a desired flow volume is facilitated; to provide a nozzle assembly in which the volume of the jet of water and air is adjustable over a wide range of flow rates while maintaining efficient operation of an ejector system used to entrain air in the flow of water; to provide a nozzle assembly in which the ejector function is isolated at low flow rates to prevent cross draw of water by another nozzle assembly in the system; to provide a nozzle assembly in which the flow control valve is operated by rotation of a delivery nozzle that is constrained against axial movement, thereby to prevent projection of the discharge nozzle into the tub and maximize the axial length of the ejector system for efficient operation; to provide a nozzle assembly having a large range of swivel adjustment of the direction of discharge of the jet of water and air; to provide a nozzle assembly having an improved tub wall mounting arrangement that holds the assembly securely and permits easy field service of components of the assembly; to provide a nozzle assembly that can be mounted in different positions with positive and complete water drainage in each position; and to provide a hydrotherapy nozzle assembly overcoming problems experienced with nozzles assemblies used in the past.

In brief, in accordance with the present invention there is provided a hydrotherapy nozzle assembly for discharging a jet of water and air into a tub. The nozzle assembly includes a housing having a forward mounting flange for attachment to a tub wall, a recessed rearward cavity, and a water supply port and an air supply port communicating with the cavity. A socket in the cavity includes an annular seal contact region separating the supply ports and dividing the cavity into water and air supply regions. A discharge ball assembly includes a ball pivotally received in the socket against the seal contact region and a forwardly extending discharge nozzle movable to selected angles in response to pivoting of the ball. A bezel surrounds the discharge nozzle and engages the ball to retain the ball in the socket. The ball includes a water inlet opening adjacent the rear end of the ball within the water supply region and an air inlet opening in the ball spaced from the rear end of the ball within the air supply region. An ejector orifice within the ball has an upstream end communicating with the water inlet opening and a downstream end communicating with the air inlet opening and with the discharge nozzle. A valve structure mounted for axial movement within the ball includes a first valve portion for controlling flow through the water inlet opening in response to axial motion of the valve structure and a second valve portion for controlling flow through the air inlet opening in response to axial motion of the valve structure. The discharge nozzle is mounted for rotational movement and constrained against axial movement relative to the ball. A cam system coupled between the discharge nozzle and the valve structure translates rotation of the discharge nozzle into axial motion of the valve structure for simultaneous adjustment of air and water flow.

BRIEF DESCRIPTION OF THE DRAWINGS

The present invention together with the above and other objects and advantages may best be understood from the following detailed description of the preferred embodiments of the invention illustrated in the drawings, wherein:

FIG. 1 is an isometric view of a hydrotherapy nozzle assembly constructed in accordance with the present invention;

FIG. 2 is a front elevational view of the nozzle assembly of FIG. 1 with the discharge ball assembly omitted;

DETAILED DESCRIPTION OF THE PREFERRED EMBODIMENT

Figure 3:
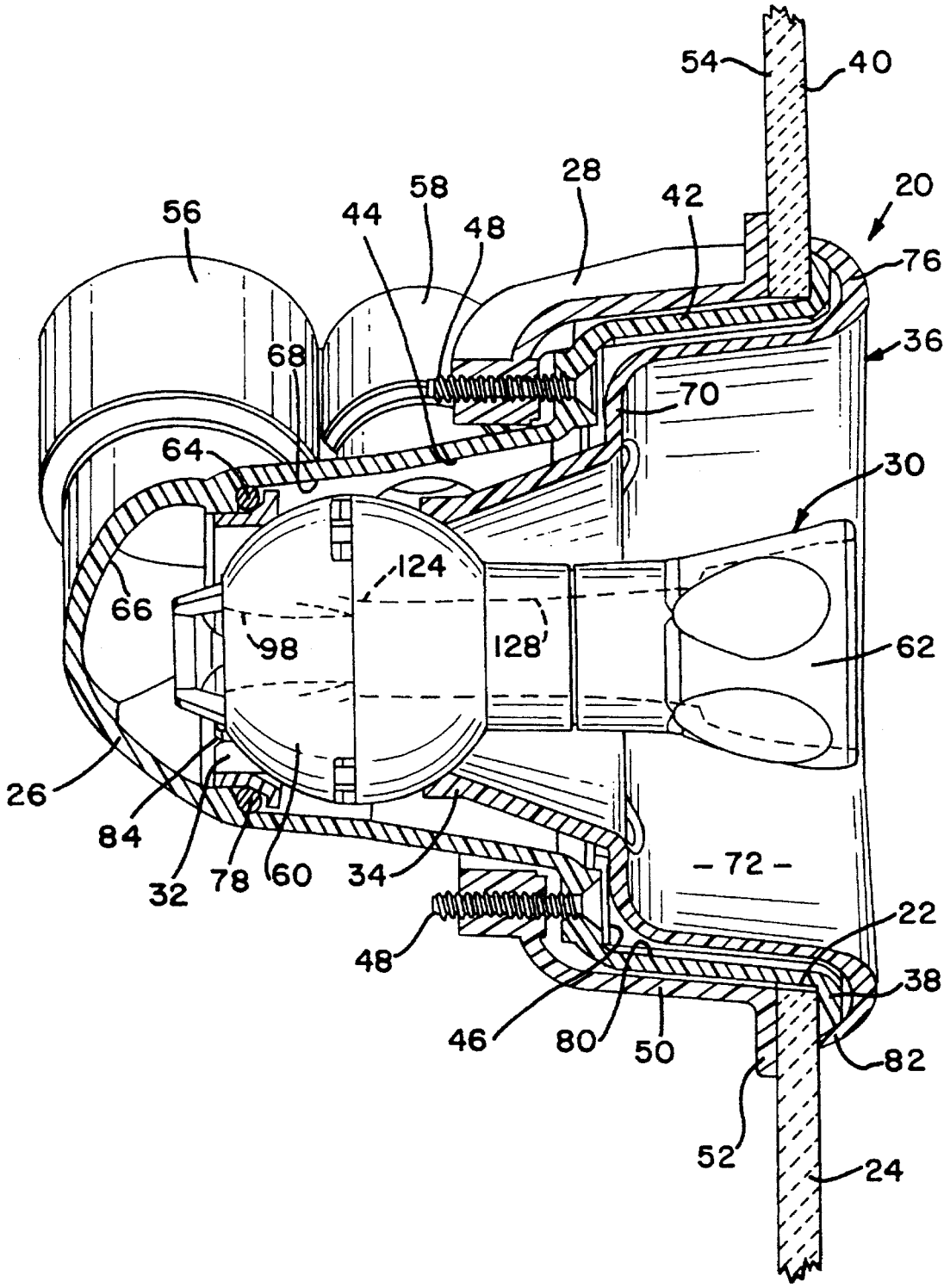
FIG. 3 is a cross-sectional view of the nozzle assembly with the discharge ball assembly in place, taken along the line 3—3 of FIG. 2 and illustrating the assembly mounted on a tub wall.

Having reference now to the drawings, and initially to FIGS. 1–6, there is illustrated a nozzle assembly generally designated as 20 and constructed in accordance with the principles of the present invention. The nozzle assembly 20 is adapted to be mounted within a circular opening 22 in the wall 24 (FIGS. 3 and 4) of a hydromassage or hydrotherapy tub or bathtub such as a whirlpool tub or spa. In general, the nozzle assembly 20 includes a body or housing 26 and a clamp member 28 used to mount the body on the wall 24. A discharge ball assembly 30 is supported for pivotal motion between a socket ring 32 and the inward retaining end 34 of a bezel 36.

A mounting flange 38 of the body 26 engages the interior surface 40 of the tub wall 24. A skirt portion 42 of the body 26 extends rearwardly, away from the interior of the tub, to a recessed cavity portion 44 of the body 26. A step 46 is located between the skirt portion 42 and the cavity portion 44. As seen best in FIG. 3, fasteners 48 extend through the step 46 and are threaded into bosses of the clamp member 28. The clamp member 28 includes an annular wall 50 that surrounds the skirt portion 42 and terminates in a clamping flange 52 engaging the exterior surface 54 of the tub wall 24 opposite the mounting flange 38. The fasteners 48 draw the flanges 38 and 52 firmly against the opposed surfaces 40 and 54 and securely hold the body 26 in place despite wall thickness variations. This clamped mounting system resists movement of the body 26 due to rotational forces applied to the body 26, for example by flow volume adjustments as described below.

Figure 4:
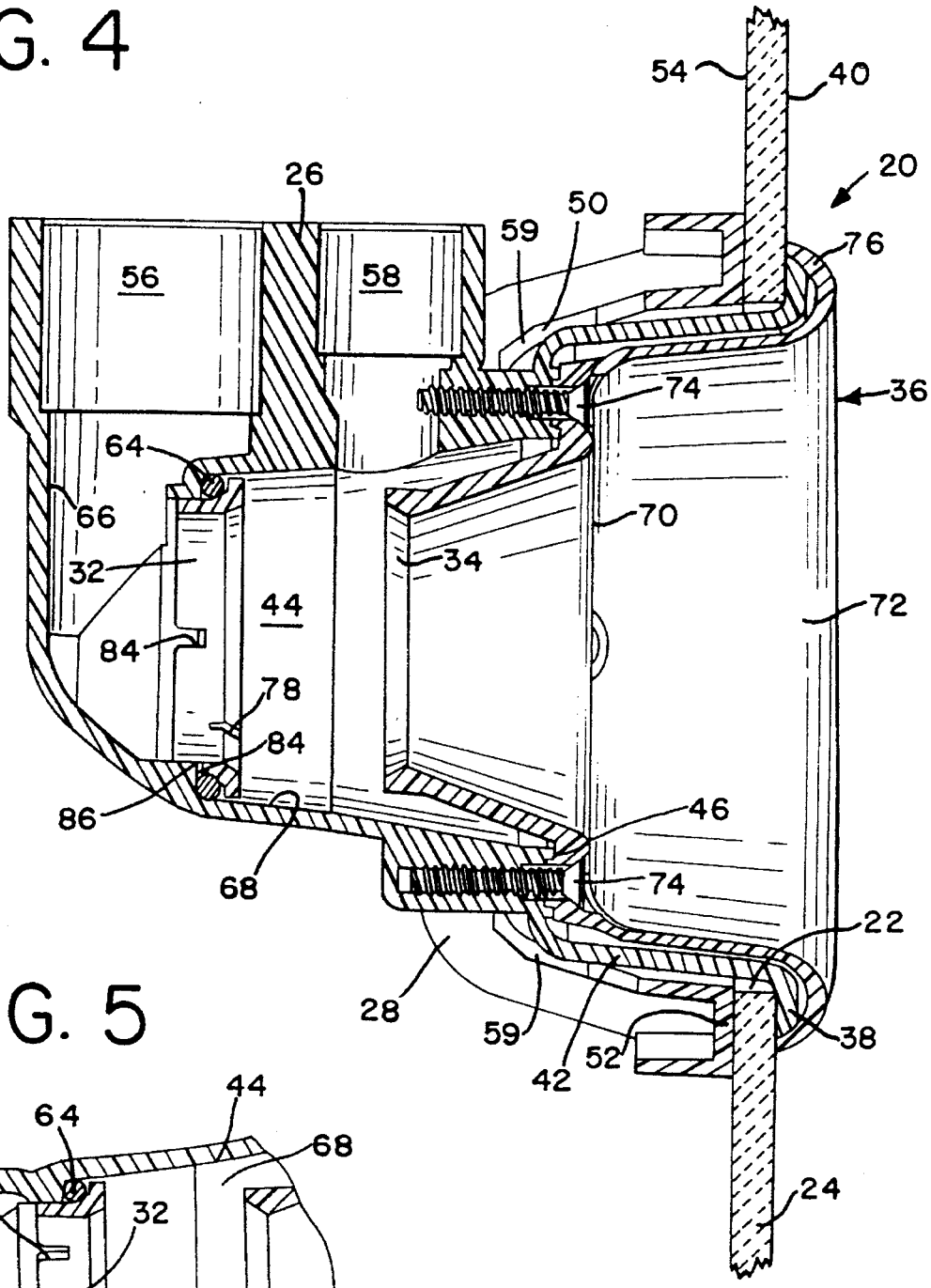
FIG. 4 is a cross-sectional view of the nozzle assembly taken along the line 4—4 of FIG. 2.

The body 26 includes a water supply port 56 and an air supply port 58, both communicating with the cavity portion 44. The ports 56 and 58 project from the body 26 generally parallel with the tub wall 24, and opposed clearance recesses 59 are provided in the annular wall 50 to permit the clamp member 28 to fit over the rear of the body 26 (FIG. 4). In a typical installation, a tub includes several nozzle assemblies 20 and water pipes connected to each water supply port 56 serve as a manifold for delivering pressurized water from a pump to each nozzle assembly 20. Ducts connected to the air supply ports 58 permit air to flow to each nozzle assembly 20 from one or more air inlets.

The discharge ball assembly 30 includes a generally spherical ball 60 held in the cavity portion 44 between the socket ring 32 and the inner end 34 of the bezel 36. A discharge nozzle 62 extends forward from the ball 60 toward the interior of the tub. Preferably the discharge nozzle 62 does not project into the tub beyond the bezel 36 and does not create an obstruction. The user can change the direction of the jet discharged from the nozzle 62 by manipulating the nozzle 62 to pivot the ball 60. A wide range of pivotal movement of about forty degrees in all directions is possible.

The socket ring includes a generally circular surface in engagement with the ball 60. An O-ring 64 is received behind the socket ring 32 against the body 26, and the socket ring 32 divides the cavity portion 44 into a water supply region 66 communicating with the water supply port 56 and an air supply region 68 communicating with the air supply port 58.

The bezel 36 includes a step 70 that seats against the step 46 of the body 26 and a skirt wall 72 that overlies the skirt portion 42 of the body 26. Fasteners 74 threaded into bosses extending below the step 46 of the body 26 attach the bezel 36 and body 26 together. The spacing between the socket ring 32 and the inner end 34 of the bezel 36 is maintained consistent despite variances in tub wall thickness so that the ball 60 is seated reliably in all installations. The bezel includes a lip 76 that covers the mounting flange 38 of the body 26. The bezel masks the body 26 and the fasteners 48 so that the appearance of the assembly 20 on the interior tub wall surface 40 is determined primarily by the bezel 36. The bezel 36 may be made of a material and provided with a surface treatment selected to provide a desired decorative effect, while the remaining components of the nozzle assembly 20 can be the same for all installations.

The flanges 38 and 52 together with the fasteners 48 permit the nozzle assembly 20 to be mounted in a selected rotational position within the circular opening 22. In the preferred embodiment of the invention illustrated in the drawings, the body 26 is mounted in either of two positions. The body 26 can be installed with the ports 56 and 58 angling upward and to the right as seen in FIG. 1 in what can be termed a 1:30 o'clock position. Alternatively, the body 26 can be installed in a ninety degree counterclockwise rotated or offset position with the ports 56 and 58 angled upward and to the left in a 10:30 o'clock position. Complete drainage of the nozzle assembly 20 is achieved in either mounting position.

After use of the nozzle assembly 20, when the supply of water to the water supply port 56 is discontinued, water is drained from the water supply piping and from the interior of the nozzle assembly 20. The water supply region 66, the port 56 and connected piping are drained through a restricted drain passage 78 in the ball contacting surface of the socket ring 32. The small volume flow through the passage 78 does not interfere with normal operation of the nozzle assembly 20 but is sufficient for gradual drainage.

Drain water from the passage 78 flows across the bottom of the air supply region 68 and over the step 46 of the body 26 to the skirt portion 42. As seen in FIG. 3, clearance is provided between the step 46 of the body 26 and the step 70 of the bezel 36. A drain channel 80 in the skirt portion 42 permits drain water to flow between the skirt portion 42 of the body 26 and the skirt wall 72 of the bezel 36 to the lip 76. A drain notch 82 in the lip 76 permits drain water to flow from the nozzle assembly 20 and down the inner tub wall surface 40 to the tub drain.

Figure 5:
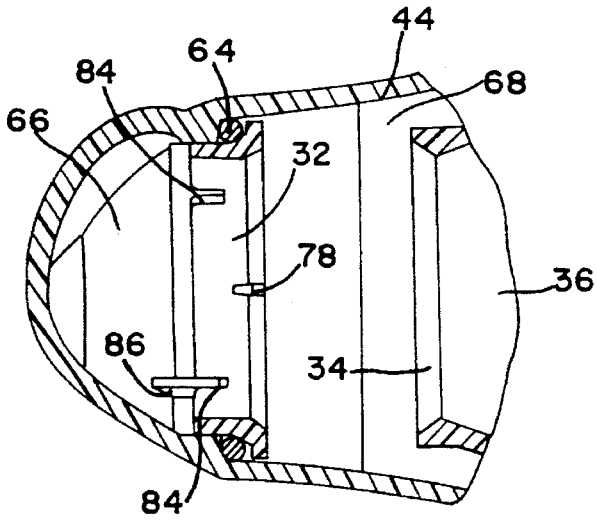
FIG. 5 is a fragmentary sectional view of part of the nozzle assembly taken along the line 5—5 of FIG. 2.
Figure 6:
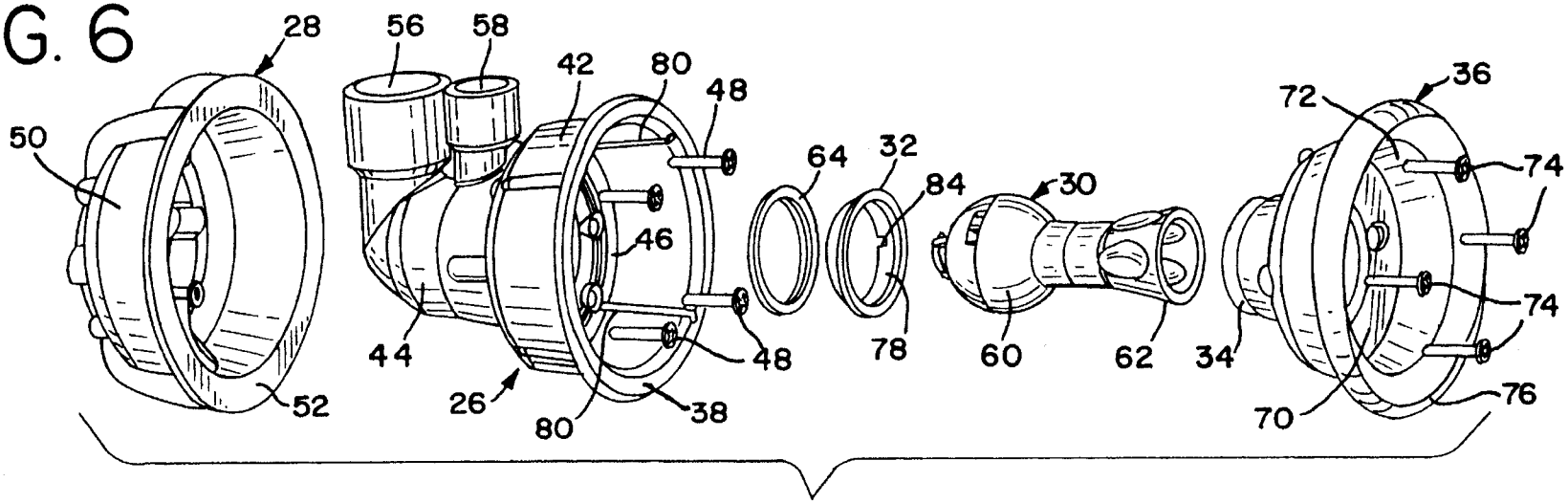
FIG. 6 is an exploded isometric view of the nozzle assembly.
Figure 10:
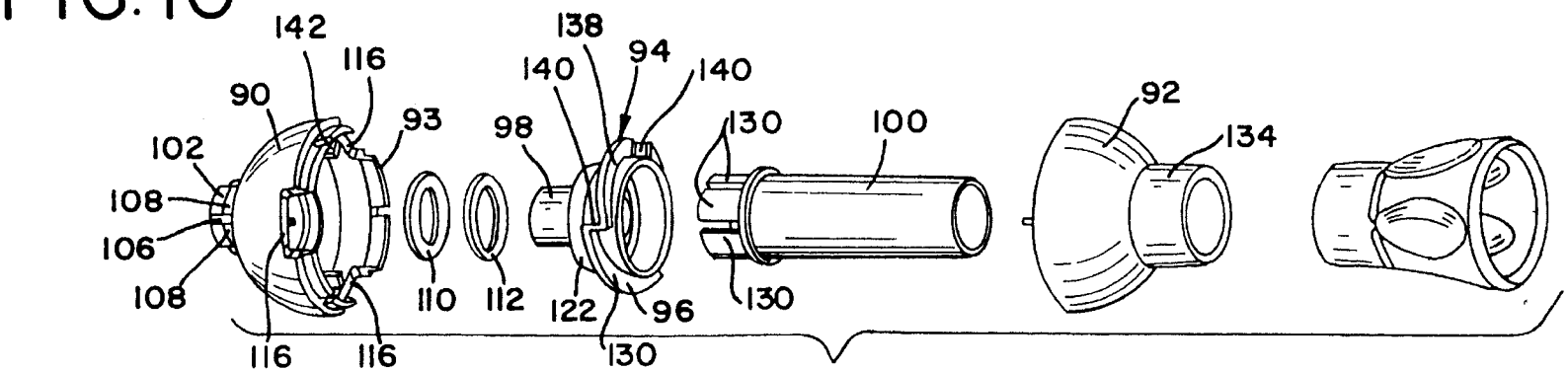
FIG. 10 is an exploded isometric view of the components of the ball jet assembly.
Figure 7:
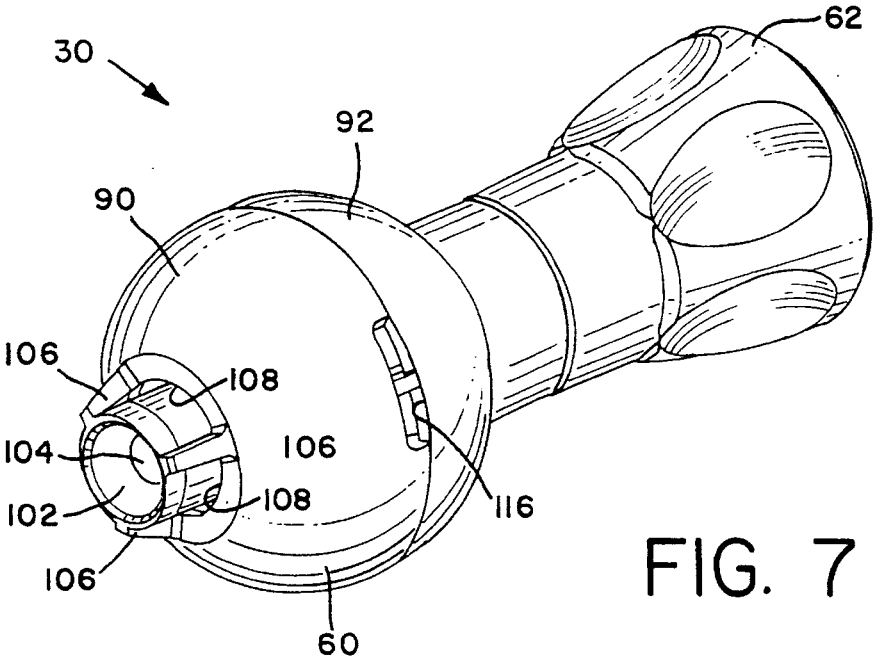
FIG. 7 is an isometric view of the discharge ball assembly of the nozzle assembly of the present invention.
Figure 8:
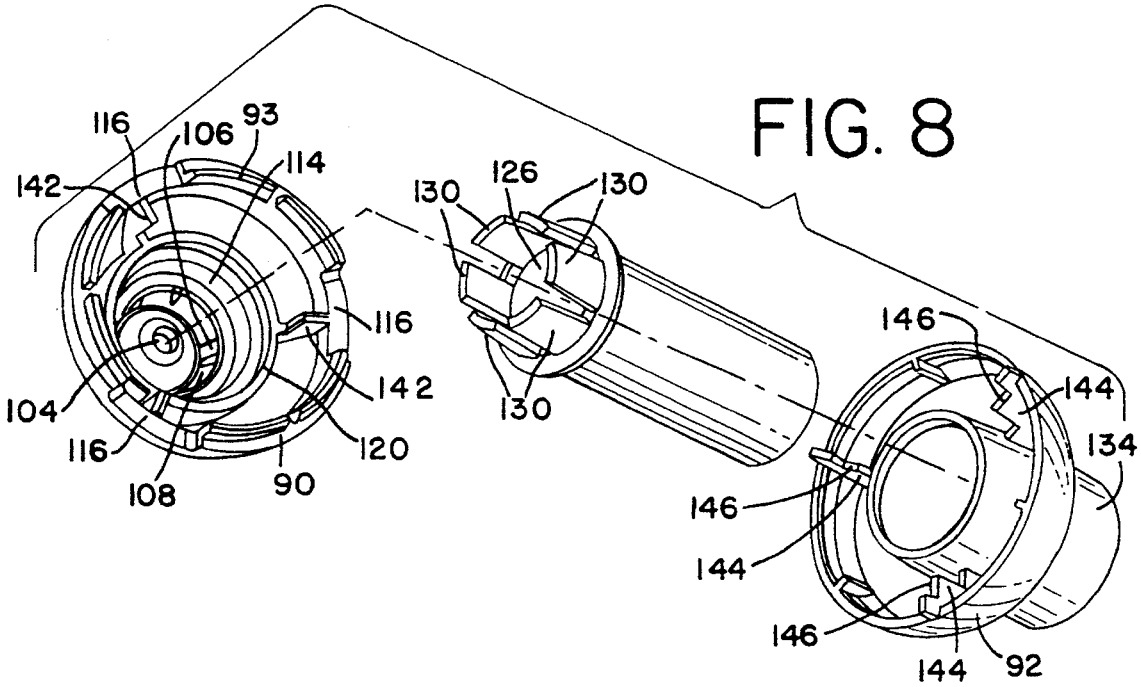
FIG. 8 is an exploded isometric view of the inlet bell, outlet bell and outlet sleeve of the discharge ball assembly

The nozzle assembly 20 can be mounted in alternate mounting positions oriented ninety degrees apart. In either position, complete drainage in enabled without difficult or complex installation procedures. The socket ring includes two index slots 84 that are located ninety degrees apart on the rear of the ring 32. In the mounting position as seen in FIGS. 4 and 5, one slot 84 mates with an index rib 86 formed in the water supply region 66 of the body cavity portion 44. This locates the drain passage 78 at the lowermost part of the socket ring 32 so that all water is drained from behind the ball 60. In the alternate mounting position, the rib 86 mates with the other index slot 84, and the socket ring 32 is located in a ninety degree offset orientation so that the drain passage 78 is at the lowermost part of the ring 32 in the ninety degree offset mounting position of the housing 26.

Fasteners 74 and the housing bosses into which they are threaded are located at ninety degree intervals (FIG. 2). As a result, the bezel 36 can easily be mounted with the drain notch 82 in the lip 76 located at the lowermost part of the lip 76. Drain channels 80 are provided at positions that are also offset by ninety degrees so that in either alternate mounting position, a drain channel 80 at the lowermost part of the skirt portion 42 is aligned with the drain notch 82.

Replacement or exchange of the bezel 36 or field service of the discharge ball assembly 30 does not require removal of the body 26 and clamp member 28 from the tub wall 24. When the fasteners 74 are withdrawn, the bezel 36 can be removed. Because the ball 60 is no longer retained by the inner end 34 of the bezel 36, the discharge ball assembly 30 can also be removed. The body 26, fasteners 48 and clamp member 28 remain in place, secured to the tub wall 24.

Referring now to FIGS. 7–11, the discharge ball assembly 30 includes an inlet bell 90 and an outlet bell 92 that mate to form the ball 60. The inlet bell 90 has a lip 93 received within the peripheral edge of the outlet bell 92. A valving member 94 including a cam structure 96 and an ejector orifice 98 is nested between bells 90 and 92. Valving member 94 moves axially in response to rotation of the discharge nozzle 62 in order to regulate the volume of water and air flow through the discharge ball assembly 30. A jet of water or of water and air flows through an outlet sleeve 100 and through the discharge nozzle 62 to the interior of the tub.

The ejector orifice 98 is at the longitudinal axis of the discharge ball assembly 30 within the inlet bell 90. A projecting seat portion 102 of the bell 90 includes a central axial water flow inlet orifice 104 that provides a continuous, focused axial water flow directly to the orifice 98. Seat portion 102 is suspended in front of the bell 90 by legs 106, and an annular, variable water flow inlet 108, concentric with central inlet 104, is defined beneath the outer edge of the seat portion. The valving structure 94 can be adjusted continuously between a forward, full open position, any selected partly open position such as those seen in FIGS. 9 and 11 and a rearward, fully closed position (FIG. 7) in which the rear edge of the orifice 98 engages the seat 102 to block all flow through the annular inlet 108. Flow through the central port 104 continues while flow through the annular port 108 is variably throttled.

The smoothly convergent shapes of the inlets 104 and 108 promote streamlined high velocity flow to the ejector orifice 98. Orifice 98 has a decreasing radius throat and, in combination with the inlets 104 and 108, efficiently converts the low velocity supply pressure of water supplied by the system pump to the water supply region 66 into a high velocity stream at a mixing region at the downstream end of the orifice 98. The high velocity stream exiting from orifice 98 creates a low pressure region around the stream in order to entrain air into a jet of intimately intermixed water and air discharged from the nozzle assembly 20.

An O-ring 110 and a thrust washer 112 are received around the orifice 98. The O-ring 110 cooperates with a collar 114 of the inlet bell 90 to isolate the interior of the ball 60 from water supplied to inlets 104 and 108. The O-ring 110 also frictionally retains the valving member 94 in any position to which it is moved. The mid portion or waist of the ball 60 is located within the air supply region 68 of the housing cavity portion 44. Three uniformly spaced air inlet windows 116 are defined by notches in the peripheral edge of the inlet ball 90 and an annular region 118 of the interior of the ball 60 around the downstream end of the orifice 98 is continuously supplied with air. The windows 116 also serve to drain to the cavity portion 44 any water that remains in the ball 60 after use of the nozzle assembly 20.

An annular seat 120 extending from collar 114 cooperates with an annular valve portion 122 of the valving member 94 to regulate the volume of the flow of air from the ball interior region 118 to a water and air mixing region 124 located where the downstream end of the orifice 98 enters the upstream entry throat 126 of the outlet sleeve 100. The valve member 94 adjusts water and air volume simultaneously. In the closed position of FIG. 7, air flow is blocked and the jet discharged into the tub consists of water supplied by the central inlet 104. In the partly open position of FIG. 9, air flow is throttled and slightly reduced in volume. In the full open position, both water and air flows are relatively unimpeded. The jet of water or water and air reaches the tub along a smooth and gradually divergent path 128 through the outlet sleeve 100 and discharge nozzle 62.

As the flow rate is decreased, the flow of air is discontinued while the flow of water continues. This isolates the air supply from the flow through the orifice 98 at low flow rates and prevents cross draw of water from the nozzle assembly 20 through the air supply port to other assemblies sharing a common air supply duct.

The axial position of the valving member 94 is adjusted by rotation of the discharge nozzle 62. A flared end portion of the nozzle 62 has an array of depressions making it easy for the user to grasp and turn the nozzle about its central longitudinal axis. This rotation acts through the cam structure 96 to axially shift the valving member 94 in order to increase or decrease the volumes of air and water in the jet discharged into the tub.

Figure 9:
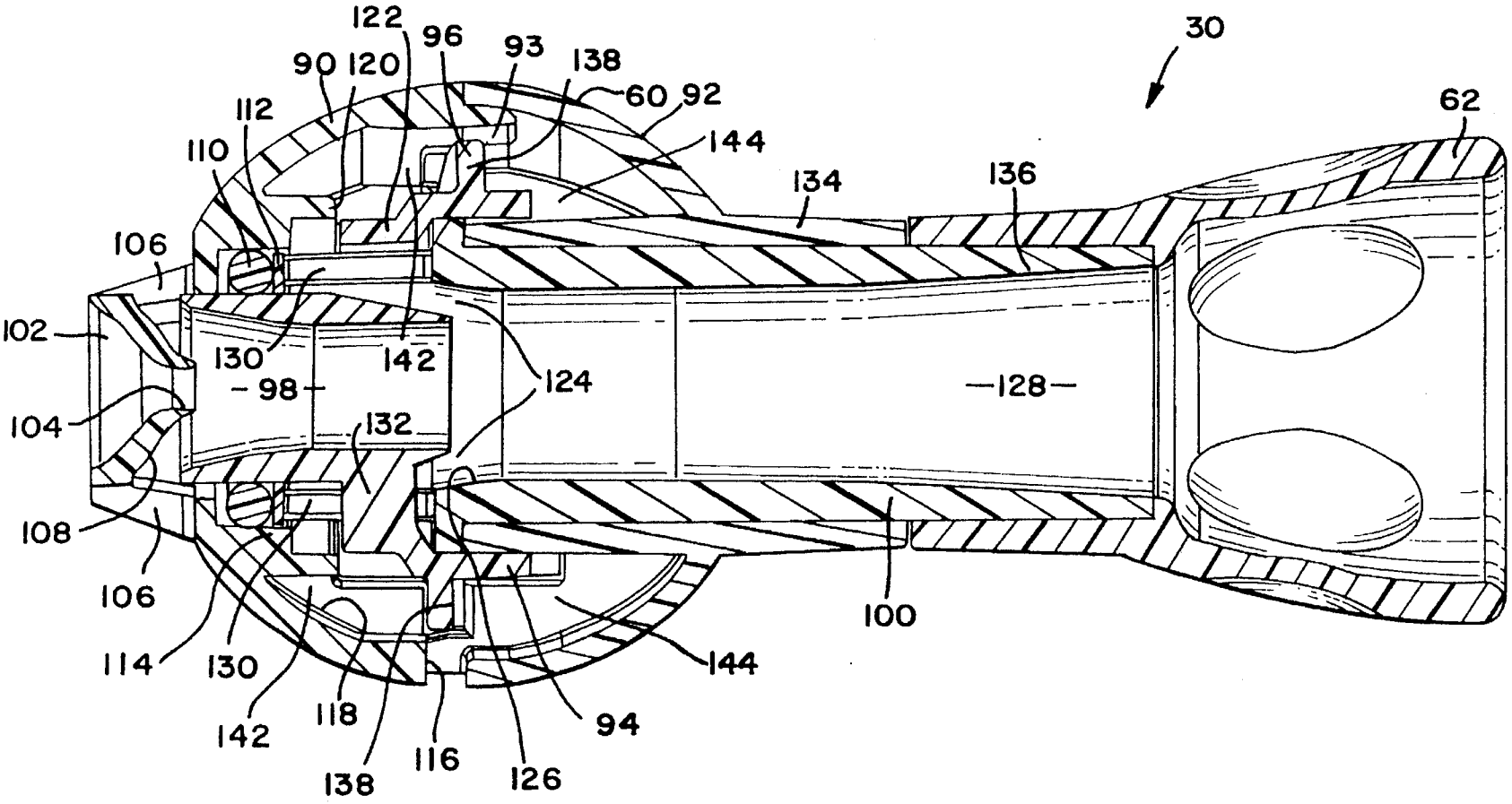
FIG. 9 is a cross sectional view on an enlarged scale of the discharge ball assembly of FIG. 7 taken along its central longitudinal axis.
Figure 11:
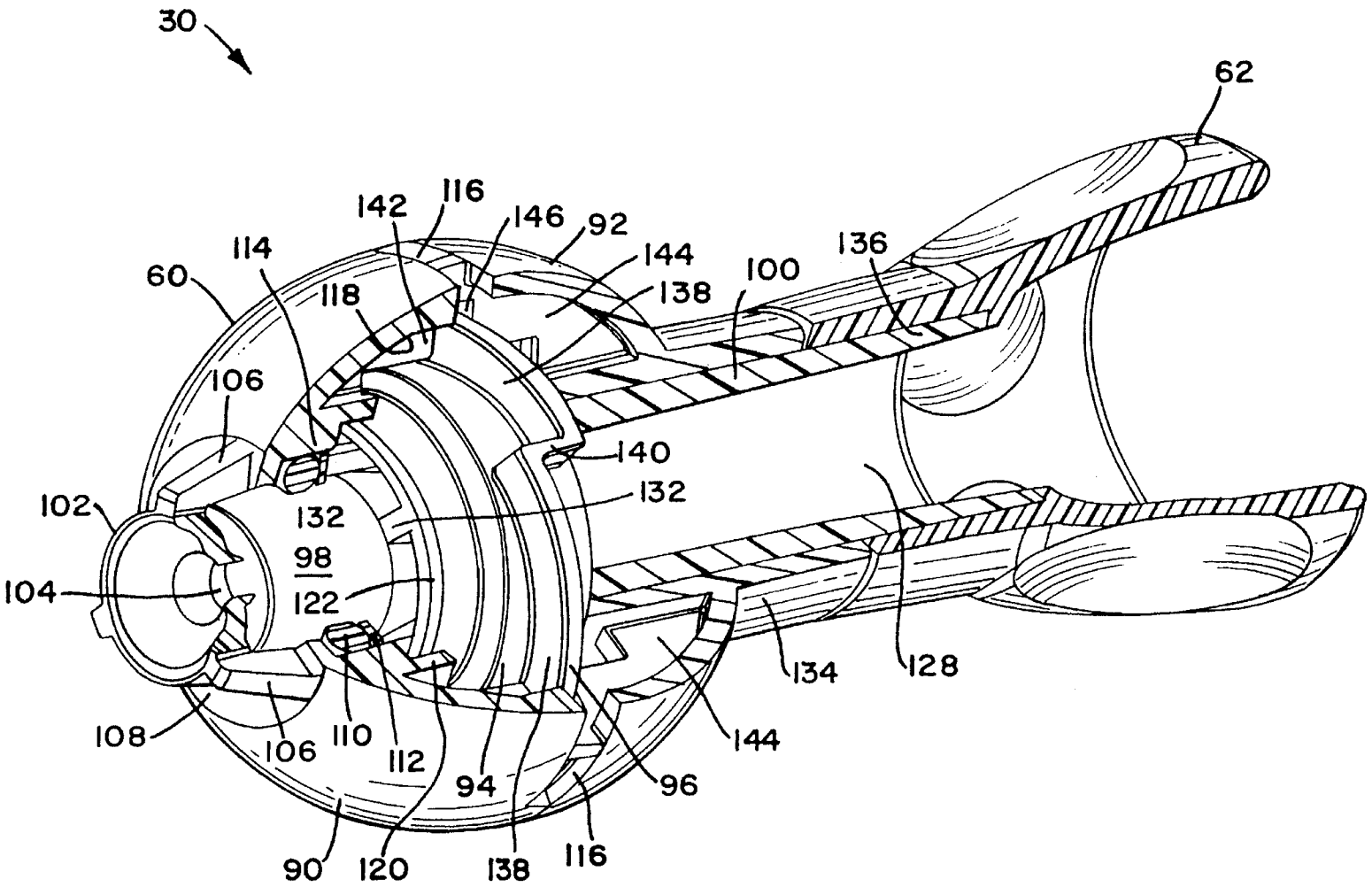
FIG. 11 is an isometric view of the discharge ball assembly of FIG. 7 on an enlarged scale with portions broken away to reveal internal structure.

The rearward end of the outlet sleeve has six spaced apart axially extending fingers 130 separated by six slots. The valving member 94 has three radial ribs 132 extending from the orifice 98 outward to the annular valve portion 122. One of these ribs is seen in FIG. 9 and FIG. 11. The ribs 132 are slidably received in alternate ones of the six slots between the fingers 130 of the outlet sleeve 100. This provides a spline drive connection that transfers rotation of the outlet sleeve 100 to the valving member 94 while leaving the valving member 94 free to move axially. The three remaining slots between fingers 130 are unrestricted. The slots 130 provide free flow of air from the annular ball interior region 118 to the mixing region 124. The ends of the fingers 130 contact the thrust washer 112 and retain the O-ring 110 in place.

The outlet sleeve 100 is journaled for rotation in a collar 134 of the outlet bell 92, and is press fit into a socket 136 at the rearward end of the discharge nozzle 62, capturing the collar between the sleeve 100 and nozzle 62. When the user rotates the discharge nozzle 62, the sleeve 100 is rotated to rotate the valving member 94. The discharge nozzle and the sleeve 100 are constrained against axial movement by engagement with the opposed ends of the collar 134.

The cam structure 96 includes three inclined ramps 138 separated by three axially extending stop walls 140 (FIG. 11). The inlet bell 90 includes three ribs 142 that are aligned with three ribs 144 in the outlet bell 92 when the bells are mated. Each ramp 138 is slidingly captured between one pair of ribs 142 and 144. A notch 146 in each rib 144 provides a bearing surface for the corresponding ramp 138. As the valving member 94 is rotated, the ramps engage the ribs 142 or 144 and axial motion is imparted to the rotating valving member 94. The stop walls 140 engage the ribs 142 or 144 and limit the rotational motion of the valving member 94 to slightly less than one hundred twenty degrees. This large range of movement between full open and full closed positions permits accurate selection of a desired flow condition.

While the present invention has been described with reference to the details of the embodiment of the invention shown in the drawings, these details are not intended to limit the scope of the invention as claimed in the appended claims.

What is claimed is:

1. A nozzle assembly for discharging a jet of water and air into a tub, said nozzle assembly comprising:

a housing defining an air inlet and a water inlet;

a water ejector nozzle having an axis;

means defining an annular water supply path surrounding said axis and extending from said water inlet to said ejector nozzle;

a water throttling valve in said annular water supply path for varying the volume of water flowing to said ejector nozzle;

a mixing region at the downstream end of said ejector nozzle;

means defining an air supply path extending from said air inlet to said mixing region;

an outlet member movably mounted in said housing and having a discharge jet path extending from said mixing region; and means coupling said outlet member to said water throttling valve for varying the water flow volume in response to movement of said outlet member;

the nozzle assembly being characterized by:

said water throttling valve being mounted for axial movement relative to said annular water supply path;

said outlet member being mounted for rotational movement and constrained from axial movement relative to said housing; and said coupling means including cam means for causing axial motion of said water throttling valve in response to rotation of said outlet member.

2. A nozzle assembly as claimed in claim 1 wherein said outlet member is mounted for pivotal motion relative to said housing in order to vary the discharge jet direction.

3. A nozzle assembly as claimed in claim 1 wherein said outlet member includes a ball and said housing includes a socket pivotally holding said ball.

4. A nozzle assembly as claimed in claim 3, said water supply path being defined in the upstream end of said ball and said air supply path being defined adjacent the waist of said ball.

5. A nozzle assembly as claimed in claim 4, said socket including a seal ring contacting said ball between said water and air supply paths and separating said air and water inlets.

6. A nozzle assembly as claimed in claim 5, said seal ring including a drain notch providing restricted flow from said water inlet around said ball, and said housing including indexing means for positioning said seal ring with said drain notch at the lowest part of said seal ring.

7. A nozzle assembly as claimed in claim 1, said air supply path comprising an annular flow path surrounding said axis of said ejector nozzle, and said water throttling valve including an additional valve portion cooperating with said air supply path for varying the air flow simultaneously with variation of the water supply flow.

8. A nozzle assembly as claimed in claim 7 further comprising a water bypass passage extending from said water inlet to said ejector orifice for supplying water to said ejector orifice independent of the position of said water throttling valve.

9. A nozzle assembly as claimed in claim 8, said bypass passage being coaxial with said ejector orifice.

10. A hydrotherapy nozzle assembly for discharging a jet of water and air into a tub, said nozzle assembly comprising:

a housing having a forward mounting flange for attachment to a tub wall, a recessed rearward cavity, and a water supply port and an air supply port communicating with said cavity;

a socket in said cavity including an annular seal contact region separating said supply ports and dividing said cavity into water and air supply regions;

a discharge ball assembly including a ball pivotally received in said socket against said seal contact region and a forwardly extending discharge nozzle movable to selected angles in response to pivoting of said ball;

a bezel surrounding said discharge nozzle and engaging said ball to retain said ball in said socket;

a water inlet opening in said ball adjacent the rear end of said ball within said water supply region and an air inlet opening in said ball spaced from the rear end of said ball within said air supply region;

an ejector orifice within said ball having an upstream end communicating with said water inlet opening and a downstream end communicating with said air inlet opening and with said discharge nozzle;

a valve structure mounted for axial movement within said ball and including a first valve portion for controlling flow through said water inlet opening in response to axial motion of said valve structure and a second valve portion for controlling flow through said air inlet opening in response to axial motion of said valve structure;

said discharge nozzle being mounted for rotational movement and constrained against axial movement relative to said ball; and a cam system coupled between said discharge nozzle and said valve structure for translating rotation of said discharge nozzle into axial motion of said valve structure for simultaneous adjustment of air and water flow.

11. A hydrotherapy nozzle assembly as claimed in claim 10, said ejector orifice being axially moveable together with said valving structure.

12. A hydrotherapy nozzle assembly as claimed in claim 11, said ejector orifice and said valving structure being integral and of one piece.

13. A hydrotherapy nozzle assembly as claimed in claim 10, comprising further comprising an annular air flow path within said ball communicating with said air inlet and surrounding the axis of said ejector orifice, and said second valve portion comprising an annular air valve portion for throttling flow through said air inlet.

14. A hydrotherapy nozzle assembly as claimed in claim 13, said water inlet comprising an annular water flow path surrounding the axis of said ejector orifice, and said second valve portion comprising an annular water valve portion for throttling flow through said water inlet.

15. A hydrotherapy nozzle assembly as claimed in claim 14 further comprising a second substantially unrestricted water bypass flow path continuously communicating between said water supply region and said ejector orifice.

16. A hydrotherapy nozzle assembly as claimed in claim 15, said bypass flow path being coaxial with said ejector nozzle for providing axial flow to said ejector orifice in all positions of said valve member.

17. A hydrotherapy nozzle assembly as claimed in claim 16, said bypass flow path being defined in a projection extending rearwardly from the rearward end of said ball.

18. A hydrotherapy nozzle assembly as claimed in claim 13 comprising a plurality of said air inlet openings distributed around the waist of said ball and communicating with said annular air flow path.

19. A hydrotherapy nozzle assembly as claimed in claim 10 wherein said bezel has a lip overlying said forward mounting flange.

20. A hydrotherapy nozzle assembly as claimed in claim 10 further comprising a discrete socket ring mounted in said cavity and including said seal contact region, said socket ring including a restricted drain passage across said seal contact region for draining said water supply port and said water supply region following use of the nozzle assembly.

21. A hydrotherapy nozzle assembly as claimed in claim 20 further comprising mounting means for mounting said housing in a plurality of different mounting positions rotated relative to said axis, and indexing means defined on said housing and said ring for locating said drain passage at the lowermost part of said seal ring in each of said plurality of positions.

22. A hydrotherapy nozzle assembly as claimed in claim 21 further comprising a clamp member adapted to engage the tub wall opposite to said mounting flange, fastener receiving openings in said clamp member and flange, and fasteners in said fastener receiving openings for drawing said clamp member and flange against opposed tub wall surfaces.

23. A hydrotherapy nozzle assembly as claimed in claim 22, said housing including a skirt extending between said cavity and said mounting flange, and a plurality of drain channels in said skirt located such that one of said drain channels is located at the lowermost part of said skirt in each of said plurality of mounting positions of said housing.

24. A hydrotherapy nozzle assembly as claimed in claim 23 wherein said bezel has a lip overlying said forward mounting flange, a drain notch in said lip, and securing means for securing said bezel to said housing with said drain notch located at the lowermost part of said bezel lip in each of said plurality of housing mounting positions.

25. A nozzle assembly of the type that can be installed in an opening in the wall of a hydrotherapy tub, said nozzle assembly comprising:

a housing having a water inlet port, a recessed cavity and a mounting flange engageable with one surface of the tub wall adjacent the opening;

a socket ring in said cavity;

a discharge ball assembly including a ball and a discharge port;

a bezel attached to said housing and surrounding said discharge port, said bezel engaging said ball to hold said ball between said socket ring and said bezel;

mounting means for mounting said housing in one of a plurality of rotationally offset mounting positions in said tub wall;

a drain passage in said socket ring for draining water from said water inlet port and past said ball following use of the nozzle assembly; and indexing means defined on said housing and socket ring for positioning said socket in one of a plurality of socket positions corresponding to said plurality of mounting positions, each said socket position locating said drain passage at the bottom of said socket ring in the corresponding one of said plurality of mounting positions.

26. The nozzle assembly of claim 25 wherein said indexing means comprises an index projection on one of said socket member and housing and a plurality of index recesses on the other of said socket ring and housing.

27. The nozzle assembly of claim 26, said projection being on said housing and said recesses being on said socket ring.

28. The nozzle assembly of claim 25 wherein there are two said mounting positions and two said socket positions.

29. The nozzle assembly of claim 25, said bezel having a lip, a drain path defined in said lip, and locating means defined on said housing and bezel for positioning said bezel in one of a plurality of bezel positions corresponding to said plurality of mounting positions, each said bezel position locating said drain path at the bottom of said lip in the corresponding one of said plurality of mounting positions.

30. The nozzle assembly of claim 29, said housing including an inner skirt extending from said cavity to said lip, said bezel including an inner skirt overlying said inner skirt and terminating in a ring portion in engagement with said ball.

31. The nozzle assembly of claim 30, further comprising a plurality of drain channels defined in one of said inner and outer skirts, one of said drain channels extending between said drain passage and said drain path in each of said plurality of mounting positions.

32. A nozzle assembly for mounting in an opening in the wall of a tub, said nozzle assembly comprising:

a housing having a mounting flange engageable with a first tub wall surface adjacent the opening, a recessed cavity having a water supply port and a first skirt extending from said flange to said cavity;

means defining a socket in said cavity;

a clamp member engageable with a second tub wall surface opposed to said first tub wall surface opposite to said mounting flange;

a plurality of fasteners extending between said housing and said clamp member for drawing said flange and clamp member together against the opposed first and second tub wall surfaces;

a discharge ball assembly including a ball seated in said socket and a discharge nozzle projecting from said ball through said first skirt, said discharge nozzle being mounted for rotation and constrained against axial motion relative to said ball, and valve means in said ball responsive to rotation of said discharge nozzle for controlling water flow from said water supply port to said discharge nozzle; and a bezel attached to said housing, said bezel having a lip overlying said mounting flange, a second skirt extending toward said ball between said discharge nozzle and said first skirt, and an inner end portion engaging said ball to hold said ball against said socket.

* * * * *